US009290876B2

(12) United States Patent
Marcellin et al.

(10) Patent No.: US 9,290,876 B2
(45) Date of Patent: Mar. 22, 2016

(54) HEAT-SHRUNK TEXTILE SLEEVE WITH EXTENDED ELECTRO-FUNCTIONAL YARN AND METHOD OF CONSTRUCTION THEREOF

(71) Applicant: Federal-Mogul Powertrain, Inc., Southfield, MI (US)

(72) Inventors: Hubert Marcellin, Crepy en Valois (FR); Jean Rene Chesnais, Crepy en Valois (FR)

(73) Assignee: Federal-Mogul Powertrain, Inc., Southfield, MI (US)

( * ) Notice: Subject to any disclaimer, the term of this patent is extended or adjusted under 35 U.S.C. 154(b) by 15 days.

(21) Appl. No.: 14/198,288

(22) Filed: Mar. 5, 2014

(65) Prior Publication Data

US 2014/0251490 A1 Sep. 11, 2014

Related U.S. Application Data

(60) Provisional application No. 61/773,462, filed on Mar. 6, 2013.

(51) Int. Cl.

| | |
|---|---|
| ***H05B 3/34*** | (2006.01) |
| ***D06C 7/00*** | (2006.01) |
| ***D03D 15/04*** | (2006.01) |
| ***H05B 3/03*** | (2006.01) |
| ***D03D 1/00*** | (2006.01) |
| ***D03D 15/02*** | (2006.01) |
| *D03D 3/02* | (2006.01) |

(52) U.S. Cl.

CPC ..... *D06C 7/00* (2013.01); *D03D 1/0035* (2013.01); *D03D 1/0088* (2013.01); *D03D 15/02* (2013.01); *D03D 15/04* (2013.01); *H05B 3/03* (2013.01); *H05B 3/347* (2013.01); *D03D 3/02* (2013.01); *D10B 2101/20* (2013.01); *D10B 2401/16* (2013.01); *D10B 2401/20* (2013.01)

(58) Field of Classification Search

None

See application file for complete search history.

(56) References Cited

U.S. PATENT DOCUMENTS

| | | | |
|---|---|---|---|
| 1,296,952 | A | 3/1919 | Handley |
| 3,669,157 | A | 6/1972 | Woodall, Jr. et al. |
| 4,664,158 | A | 5/1987 | Sands |

(Continued)

FOREIGN PATENT DOCUMENTS

| | | | |
|---|---|---|---|
| JP | 2010261116 | A | 11/2010 |
| JP | 2012241293 | A | 12/2012 |

OTHER PUBLICATIONS

International search report mailed Jun. 11, 2014 (PCT/US2014/020550).

*Primary Examiner* — Joseph M Pelham

(74) *Attorney, Agent, or Firm* — Robert L. Stearns; Dickinson Wright, PLLC

(57) ABSTRACT

A textile sleeve has wall of interlaced warp yarn and weft yarn. The warp yarn extends lengthwise along a longitudinal axis of the sleeve between opposite first and second ends of the sleeve. The warp yarn is non-metallic heat-shrinkable polymeric yarn. The sleeve has at least one electro-functional member interlaced with some of the weft yarn. The at least one electro-functional yarn extends along the longitudinal axis between the first and second ends. The non-metallic polymeric warp yarns have a greater heat-shrinkage ratio than the at least one electro-functional member. The non-metallic polymeric warp yarns are caused to be shortened in the lengthwise direction along the longitudinal axis relative to the at least one electro-functional member upon being heated.

13 Claims, 3 Drawing Sheets

(56) References Cited

U.S. PATENT DOCUMENTS

| | | | | |
|---|---|---|---|---|
| 4,668,545 | A * | 5/1987 | Lowe | 428/35.1 |
| 4,700,054 | A * | 10/1987 | Triplett et al. | 219/545 |
| 4,816,028 | A | 3/1989 | Kapadia et al. | |
| 4,836,080 | A | 6/1989 | Kite, III et al. | |
| 4,983,814 | A * | 1/1991 | Ohgushi et al. | 219/545 |
| 5,236,765 | A * | 8/1993 | Cordia et al. | 428/192 |
| 6,020,578 | A * | 2/2000 | Putz | 219/545 |
| 6,452,138 | B1 * | 9/2002 | Kochman et al. | 219/549 |
| 8,298,968 | B2 * | 10/2012 | Swallow et al. | 442/229 |
| 8,669,195 | B2 * | 3/2014 | Swallow et al. | 442/229 |
| 2002/0195260 | A1 | 12/2002 | Marks | |
| 2006/0281382 | A1 * | 12/2006 | Karayianni et al. | 442/181 |
| 2008/0233822 | A1 * | 9/2008 | Swallow et al. | 442/185 |
| 2009/0159149 | A1 * | 6/2009 | Karayianni et al. | 139/425 R |
| 2011/0047957 | A1 * | 3/2011 | Richard | 57/236 |
| 2013/0020313 | A1 * | 1/2013 | Swallow et al. | 219/545 |
| 2013/0243985 | A1 * | 9/2013 | Furuta et al. | 428/36.1 |
| 2014/0273699 | A1 * | 9/2014 | Zhang et al. | 442/316 |

* cited by examiner

HEAT-SHRUNK TEXTILE SLEEVE WITH EXTENDED ELECTRO-FUNCTIONAL YARN AND METHOD OF CONSTRUCTION THEREOF

CROSS-REFERENCE TO RELATED APPLICATION

This application claims the benefit of U.S. Provisional Application Ser. No. 61/773,462, filed Mar. 6, 2013, which is incorporated herein by reference in its entirety.

BACKGROUND

1. Technical Field

This invention relates generally to textile sleeves used for wrapping cables, tubing and the like, and more particularly to such sleeves having one or more metallic yarns or wires incorporated into the textile sleeve material and to methods of making such sleeves.

2. Related Art

Textile sleeves for wrapping and guiding a bundle of wires or shrouding other elongate articles, such as tubes, are sometimes fabricated to include one or more conductive or resistive metallic wires. The wires may be incorporated into the textile structure of the sleeve (e.g., woven) and may extend in the lengthwise direction with ends of the wires extending beyond the ends of the textile material to present projecting electrical leads at one or both ends of the wires for connection to a power source. One known method for making such a textile sleeve structure having conductive and/or resistive wires involves weaving the textile sleeve and integrating the one or more conductive wires as part of the woven structure during manufacture of the textile sleeve. Afterward, the ends of the textile material are trimmed back to expose the ends of the one or more wires so they end up extending beyond the trimmed ends of the textile sleeve material and can serve as leads for connection to a power source. While effective, such a process is laborious and adds to the manufacturing cost of such textile sleeves.

SUMMARY

A textile sleeve is fabricated of non-metallic polymeric filaments or yarns that are interlaced to form an elongate tubular structure (either wrappable or self-wrapping). The yarns may be monofilament or multifilament or a combination thereof. The sleeve includes at least one metallic yarn or wire (conductive and/or resistive and/or data transmission wire, etc.) that may be intertwined (served, twisted, or otherwise) with some of the non-metallic yarns of the sleeve. The at least one wire extends in the lengthwise direction of the sleeve. At least some of the non-metallic yarns that extend in the longitudinal direction of the sleeve are selected from a non-metallic polymeric material that has a greater heat-shrinkage ratio than that of the at least one wire. After the structure of the textile sleeve is formed, heat is applied to all or select parts of the sleeve, causing the yarns of greater heat-shrinkage ratio to contract, and thus, shorten in the lengthwise direction relative to the at least one metallic wire. As an alternative or in addition to the metallic wire, one or more fiber optic stands or wires may be incorporated into the textile sleeve structure. The metallic and/or fiber optic wires can be considered "electro-functional" yarns or wires in that they are employed for electrical conduction, resistance and/or data transfer, etc., as distinguished from the remainder of the structural textile yarns of the sleeve. The result is a heat-shrunk, contracted length, textile sleeve structure with end portions of the electro-functional wires projecting longitudinally beyond the shrunken ends of the textile sleeve structure.

In accordance with another aspect of the invention, a method of constructing a textile sleeve is provided. The method includes forming a wall by interlacing heat-shrinkable non-metallic polymeric warp yarn with weft yarn, with the warp yarn extending lengthwise along a longitudinal axis of the sleeve and the weft yarn extending widthwise transversely to the longitudinal axis between opposite edges. Further, interlacing at least one electro-functional member in yarns of the wall with the at least one electro-functional yarn extending along the longitudinal axis, wherein the non-metallic polymeric warp yarns have a greater heat-shrinkage ratio than the at least one electro-functional member. Then, cutting the wall and at least one electro-functional member to a first length extending between opposite ends of the wall and the at least one electro-functional member. Further yet, heating the wall and causing the non-metallic polymeric warp yarns to shorten lengthwise to a second length that is shorter than the first length and causing the at least one electro-functional member that substantially retains its first length to project longitudinally beyond the shrunken opposite ends of the wall.

BRIEF DESCRIPTION OF THE DRAWINGS

These and other features and advantages described below will be appreciated by those of ordinary skill in the art when considered in connection with the drawing figures, in which.

DETAILED DESCRIPTION OF PRESENTLY PREFERRED EMBODIMENTS

Figure 1:
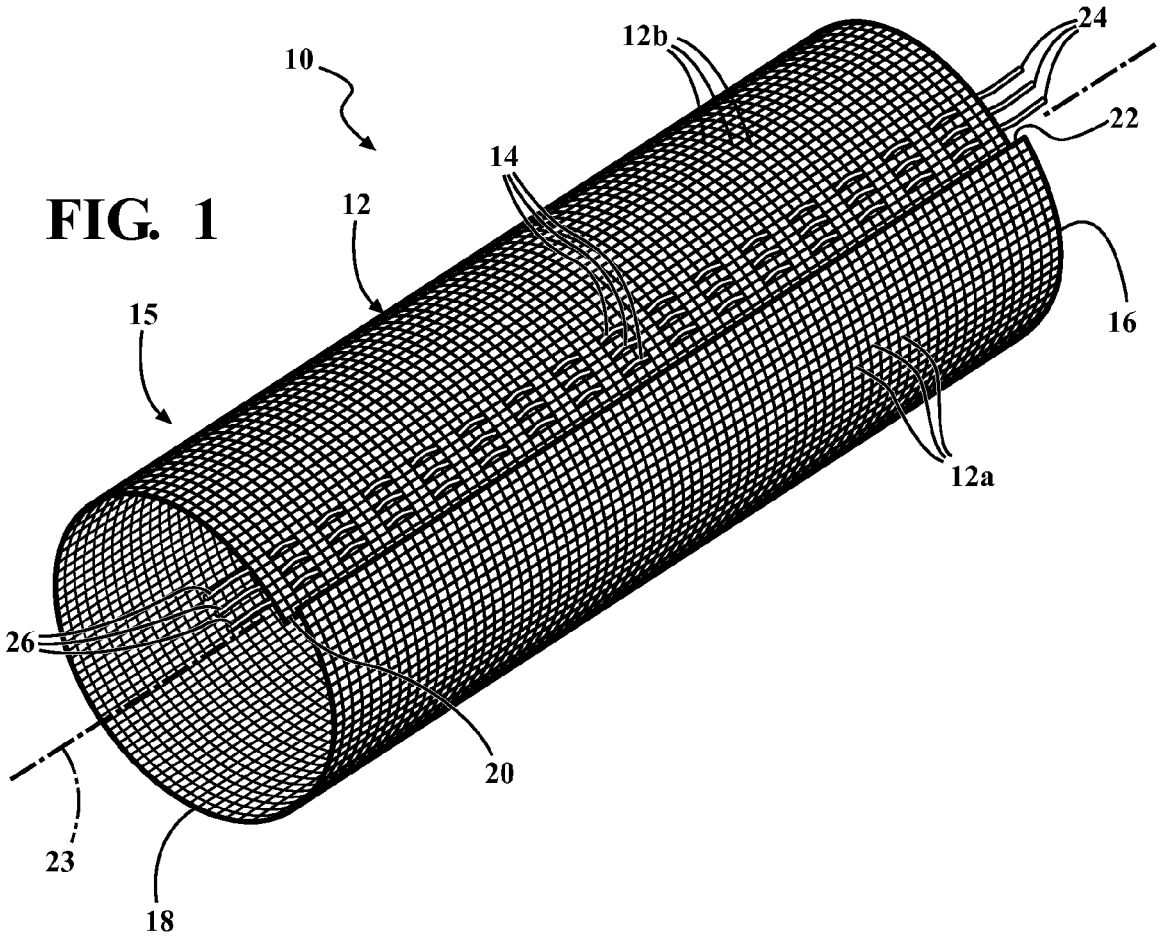
FIG. 1 is a perspective view of a textile sleeve constructed in accordance with one embodiment of the invention.

FIG. 1 illustrates a textile sleeve 10 constructed in accordance with one embodiment of the invention having a plurality of non-metallic textile yarns, also referred to simply as yarns 12, and at least one electro-functional member, also referred to as electro-functional yarn 14. The yarns 12 may be fabricated of any of a number of non-metallic materials. Such materials include organic polymeric materials (plastics), natural fibers, mineral fibers and/or combinations thereof. The yarns 12 may be monofilament or multifilament yarns or they may be a combination of monofilament and multifilament yarns. The yarns 12 may be of the same or different diameters or denier. The electro-functional yarn 14 may comprise a single strand of wire or a multifilament (e.g., braided) structure, with the term "yarn" covering both mono and multi filament constructions of the electro-functional yarn 14. The electro-functional yarn 14 may comprise at least one of electrically conductive metallic material, electrically resistive metallic material and fiber optic material, or pluralities or combinations thereof.

The non-metallic yarns 12 are interlaced with one another to form a wall structure, referred to hereafter as wall 15, of the sleeve 10. The interlacing may be a woven, braided, knit or other structure. A woven structure of the nonmetallic yarns 12 is shown schematically in the drawings for making the textile sleeve 10, though the aforementioned interlacing structures are contemplated herein. Some of the nonmetallic yarns, designated by 12*a*, extend in the longitudinal lengthwise direction of the sleeve 10 to opposite sleeve ends 16, 18 of the sleeve 10, generally referred to as warp yarns 12*a*. Some of the nonmetallic yarns, designated by 12*b*, extend in the crosswise, circumferential direction of the sleeve 10, generally referred to as fill or weft yarns 12*b*. The sleeve 10 may be configured to be generally tubular in construction. This tubular shape of the sleeve 10 may be achieved by fabricating the wall 15 of the sleeve 10 having a width and length, and curling or wrapping the wall 15 of the sleeve 10 into the tubular shape. Such a sleeve 10 has a split or seam, sometime referred to as an "open" sleeve construction, as illustrated in FIGS. 1 and 2, wherein the sleeve 10 is parted along its length by the seam to present overlapping first and second sleeve edges 20, 22 extending along a longitudinal axis 23, shown as being generally parallel thereto, wherein the fill yarns 12*b* extend generally between the edges 20, 22 transversely to the longitudinal axis 23.

Figure 2:
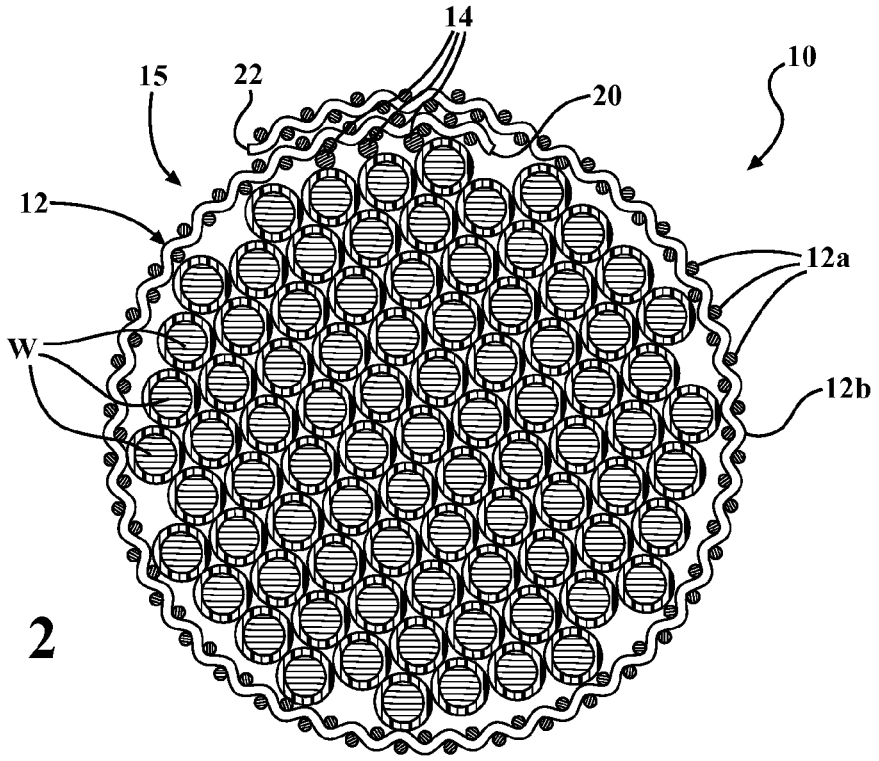
FIG. 2 is a cross-sectional view of the sleeve of FIG. 1 shown wrapped about an elongate member to be protected.

At least some of the fill yarns 12*b* may be fabricated of a heat-shapeable polymeric material, that are well known per se in the art, which enables the manufactures of the sleeve 10 to heat-set such fill yarns 12*b* of the wall into a pre-curved or curled shape that self-biases the wall 15 of the sleeve 10 into a self-curled, closed tubular condition with the opposite edges 20, 22 overlapping one another such that the first edge 20 is radially inward of the radially outer second edge 22, as illustrated best in FIG. 2. FIG. 2 further shows the sleeve 10 wrapped about a bundle of wires W or other elongate article (e.g., tubing), such as might be found in an engine compartment of a motor vehicle or aircraft, by way of example and without limitation.

At least some of the warp yarns 12*a* are fabricated of nonmetallic polymeric material (monofilament and/or multifilament) that is selected to have a higher heat-shrink ratio than that of the electro-functional yarns 14. In other words, the selected warp yarns 12*a* having a higher heat-shrink ratio are caused to shrink in length when exposed to sufficient heat by an amount greater than any shrinkage of the electro-functional yarns 14, if any. All or some of the warp yarns 12*a* may be fabricated of the selected heat-shrinkable material. The heat-shrinkable material can be selected from any number of materials so long as the shrinkage rate is greater than that of the electro-functional yarn 14. A heat-shrinkable material is polyester yarn, but the selection of this material is not meant to be limiting. The electro-functional yarn 14 may be copper if it is meant to be electrically conductive, but the selection of copper is not meant to be limiting.

As illustrated best in FIGS. 3-6, the nonmetallic 12 and metallic yarns 14 are interlaced, such as by weaving, such that the metallic yarns 14 extend in the warp, lengthwise direction of the sleeve 10 from one end 16 to another 18. The metallic yarns 14 may be incorporated near and adjacent one of the edges 20 or 22 of the sleeve 10, and preferably adjacent the radially inward inner edge 20, such that the metallic yarns 14 underlie a portion of the wall of the sleeve 10 adjacent the overlapping radially outward edge 22 with the wall 15 of the sleeve 10 in the wrapped condition, as illustrated. As such, with the metallic yarns 14 being entirely covered by the overlying portion of the sleeve 10, maximum protection is provided by the overlapping portion to the underlying electro-functional yarns 14 from exposure to external factors, including abrasion, exposure to contamination elements in the external environment, etc.

The heat shrinkable nonmetallic yarns 12*a* also extend in the warp or lengthwise direction and the electro-functional yarns 14 and nonmetallic warp yarns 12*a* are interlaced with the weft or fill yarns 12*b*, wherein at least some of the fill yarns 12*b* may be heat-set for self-curling as described above.

Figure 3:
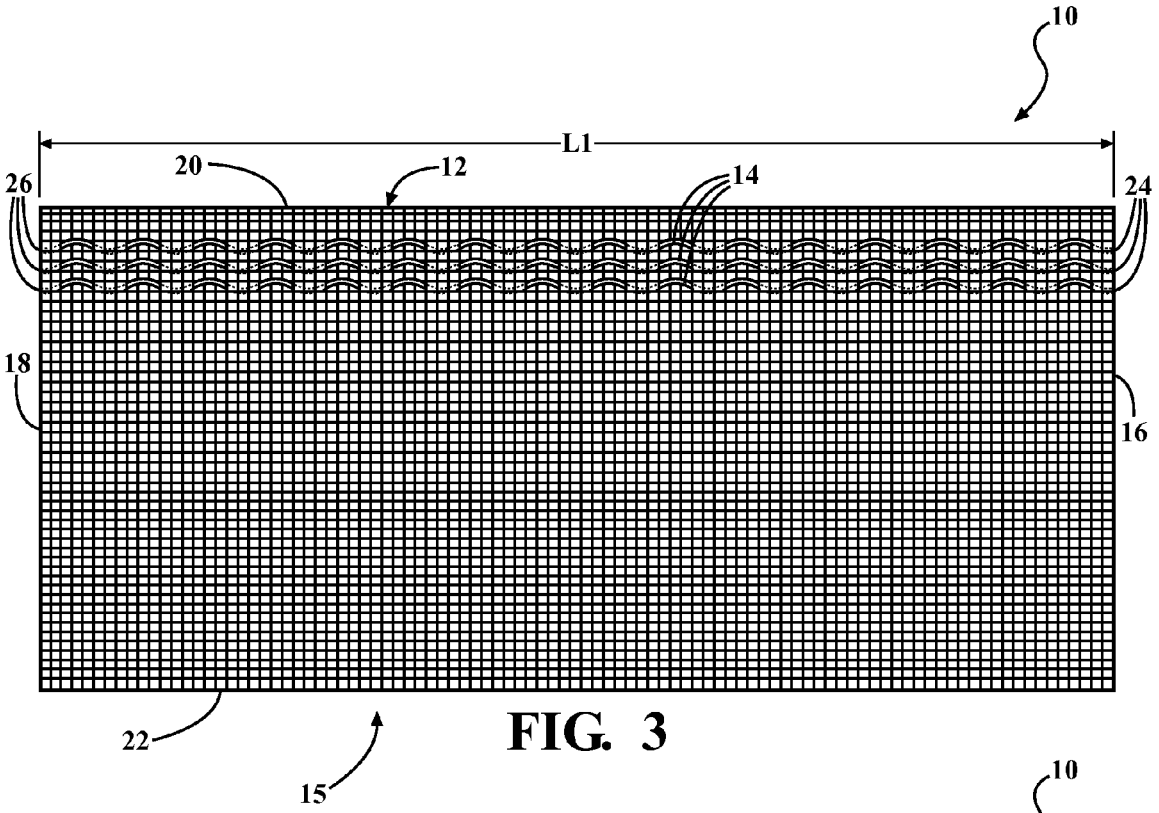
FIG. 3 is a plan view of a wall of the sleeve of FIG. 1 before heat-shrinking the wall.
Figure 4:
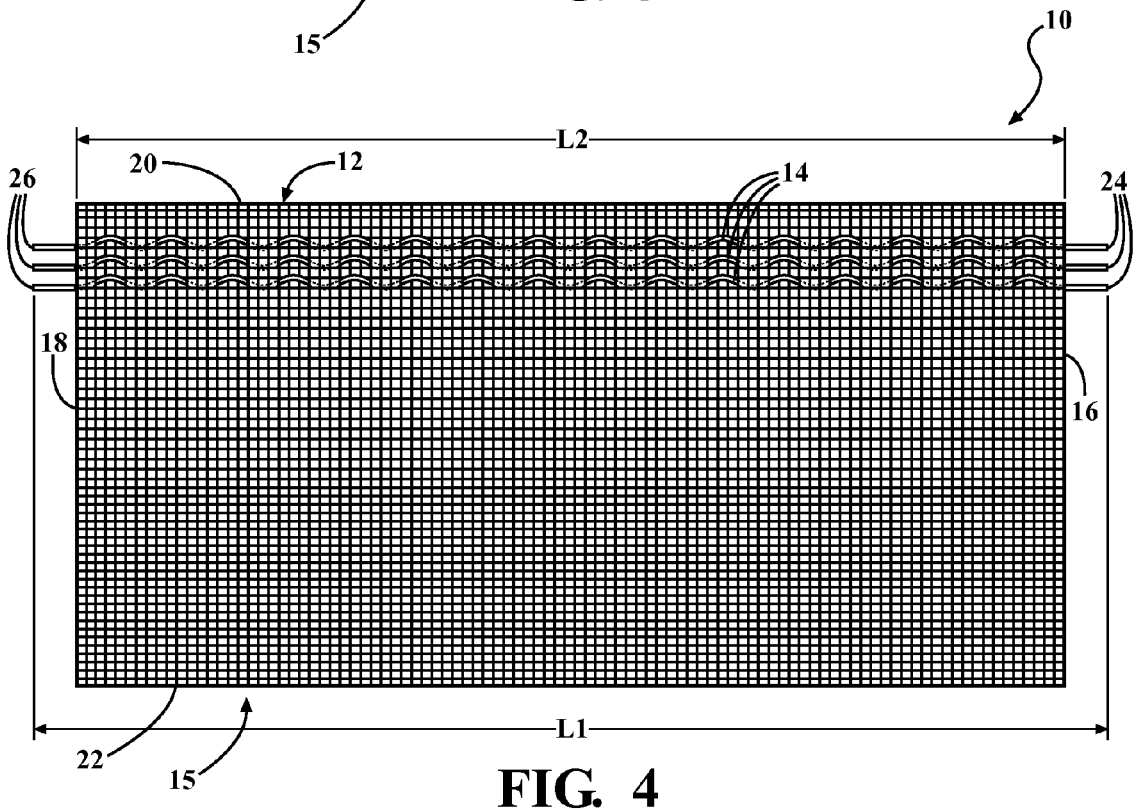
FIG. 4 is a view similar to FIG. 3 but illustrating the wall after heat-shrinking the wall.
Figure 5:
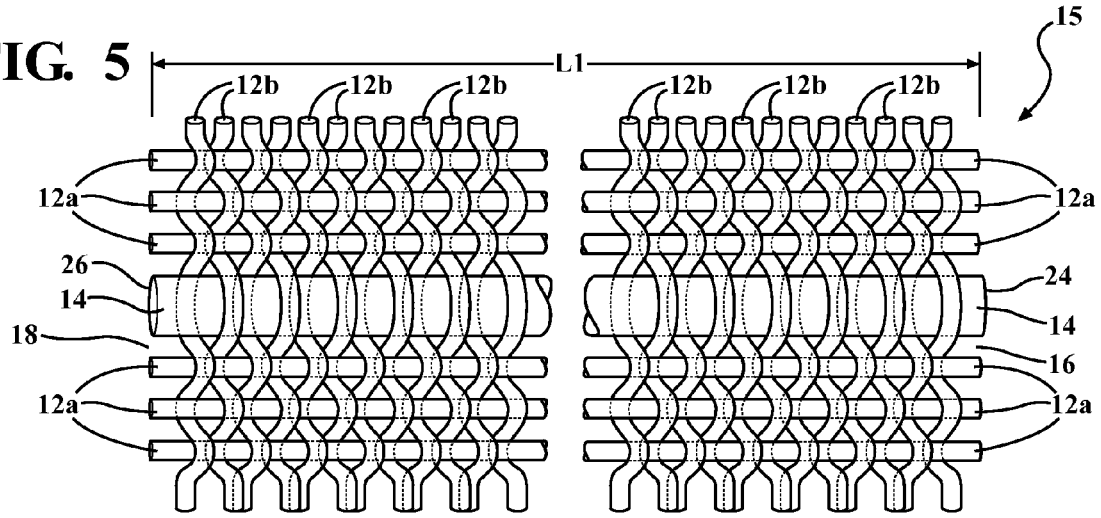
FIG. 5 is an enlarged fragmentary plan view of the wall of FIG. 3 in the pre-shrunk state.
Figure 6:
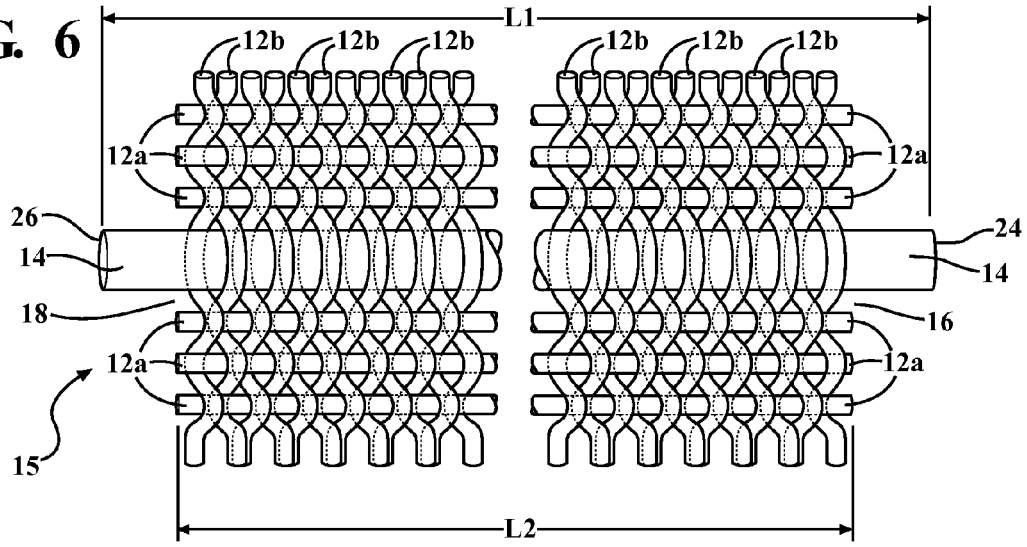
FIG. 6 is a view similar to FIG. 5 but in the heat shrunk state.
Figure 7:
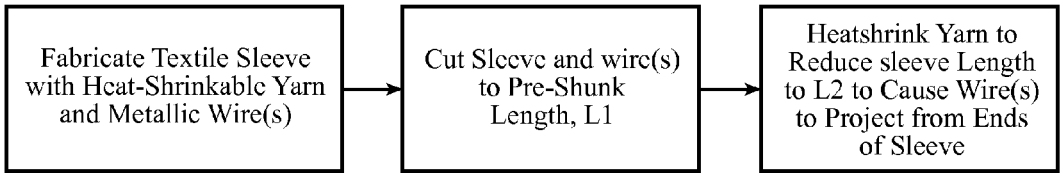
FIG. 7 is a flow chart of a method of making a sleeve in accordance with one aspect of the invention.

Still referring to FIGS. 3-6, but also to the process flow chart of FIG. 7, the wall 15 and at least one electro-functional yarn 14 may be cut to an initial length L1 corresponding to a final desired effective length of the electro-functional yarns 14 as measured longitudinally between its opposite longitudinal ends 24, 26. It will be understood that the length of the electro-functional yarns 14, once interlaced into the wall 15, may be shorter than the true straight length of the electro-functional yarn 14 if it was measured on its own apart from the textile sleeve 12, due to the bends and curvature that may be imparted to the electro-functional yarn 14 as a result of interlacing. The initial length L1 of the pre-shrunk sleeve 10 is illustrated in FIGS. 3 and 5.

Once the wall 15 of the textile sleeve 10 and electro-functional yarns 14 have been cut to the initial length L1, the wall 15 of the sleeve 10 may be heated to a temperature sufficient to cause the heat-shrinkable warp yarns 12*a* to shrink and contract in length. This is illustrated best by a comparison of FIGS. 3 and 5 with FIGS. 4 and 6, wherein it will be seen that the non-metallic warp yarns 12*a* have been heat-shrunk to a contracted length L2 and thus, have decreased in length relative to their original pre-shrunk length L1 and likewise decreased in length relative to the length L1 of the electro-functional yarns 14. Accordingly, the opposite ends 16, 18 of the wall 15 are effective brought closer to one another as a result of the length of the wall 15 decreasing. It will be seen that the length of the electro-functional yarns 14 may be generally unaffected by the heating of the sleeve 10, such that they retain or substantially retain their original cut length, in this case L1.

FIGS. 1, 4 and 6 illustrate the effect of the shrinkage in length of the heat-shrinkable warp yarns 12*a*, which is to cause the overall length of the textile sleeve 10 to shrink relative to the electro-functional yarns 14. The net result of the contraction of the textile sleeve 10 is that end portions 24, 26 of the electro-functional yarns 14 project lengthwise beyond the ends 16, 18 of the textile sleeve 10. These projecting ends 24, 26 may serve as leads for electrical connections of the metallic yarns 14 to some external electrical component. For the textile sleeve 10 to be able to shrink relative to the metallic yarns 14, the textile sleeve material, and in particular, the weft yarns 12*b* and warp yarns 12*a* adjacent the electro-functional yarns 14 must be able to slip relative to the metallic yarns 14 so that the ends 24, 26 of the metallic yarns end up projecting longitudinally beyond the ends 16, 18 of the sleeve 10 after heat-shrinkage of the textile sleeve 10. The woven structure is one way of achieving such relative slippage.

It will be appreciated that the entire sleeve 10 may be uniformly heated to impart the shrinkage, or only select portions of the sleeve 10 (e.g., just end regions, just a middle region, or multiple regions of shrunk portions separated by non-shrunk portions).

It will be appreciated that the extension of the electro-functional yarn ends 24, 26 beyond the ends 16, 18 of the textile sleeve 10 is achieved by means of the heat-shrinkage of the warp nonmetallic yarns 12*a*, and no cutting of the nonmetallic warp yarns 12*a* relative to the electro-functional yarns 14 to make them relatively shorter is necessary. The wall 15 may be cut to the initial length L1 and then heated to cause the non-metallic textile portion 12*a* to shrink back to length L2 and thereby expose the ends 24, 26 of the electro-functional yarns 14. The extension of the electro-functional yarn ends 24, 26 beyond the textile sleeve ends 16, 18 may be (L1−L2)/2.

Thus contemplated is a sleeve 10 of nonmetallic textile yarn material 12 incorporating at least one electro-functional yarn 14 extending in the lengthwise direction and of different material than other lengthwise textile yarns, and having end portions 24, 26 projecting beyond ends 16, 18 of the textile sleeve 10, and wherein at least some of the lengthwise non-metallic yarns 12 are heat-shrunk to a length L2 shorter than that L1 of the electro-functional yarns 14.

Further contemplated is a method of making a textile sleeve 10. The method includes forming a wall 15 by interlacing heat-shrinkable non-metallic polymeric warp yarn 12*a* with weft yarn 12*b*, with the warp yarn 12*a* extending lengthwise along a longitudinal axis 23 and the weft yarn 12*b* extending widthwise transversely to the longitudinal axis 23 between opposite edges 20, 22. Further, interlacing at least one electro-functional member 14 in yarns of the wall 15 with the at least one electro-functional yarn 14 extending along the longitudinal axis 23 in generally parallel relation therewith, wherein the non-metallic polymeric warp yarns 12*a* have a greater heat-shrinkage ratio than the at least one electro-functional member 14. Then, cutting the wall 15 and at least one electro-functional member 14 to a first length extending between opposite ends of the wall and the at least one electro-functional member. Further yet, heating the wall 15 and causing the non-metallic polymeric warp yarns to shorten lengthwise to a second length that is shorter than the first length and causing the at least one electro-functional member that substantially retains its first length to project longitudinally beyond the shrunken opposite ends of the wall 15. Further, upon heating the wall 15, the weft yarns 12*b*, if provided as heat-settable filaments, are caused to take on a heat-set curl to bias opposite lengthwise extending edges 20, 22 into overlapping relation with one another, thereby covering the at least one electro-functional yarn 14 with a portion of the sleeve wall adjacent the outer edge 22 to shield and protect the at least one electro-functional yarn 14 against abrasion and from elements in the external environment. It should be recognized that the opposite edges 20, 22 of the sleeve 10 could be manually wrapped into overlapping relation with one another and maintained in their overlapped relation via a suitable fastener if desired.

The foregoing description is exemplary rather than limiting in nature. Variations and modifications to the disclosed embodiment may become apparent to those skilled in the art are herein incorporated within the scope of the invention, which is ultimately defined by the claims.

What is claimed is:

1. A textile sleeve, comprising:

a wall of interlaced warp yarn and weft yarn, said warp yarn extending lengthwise along a longitudinal axis of the sleeve between opposite first and second ends of the sleeve, said warp yarn including heat-shrinkable non-metallic polymeric warp yarn;

at least one electro-functional member interlaced with some of said weft yarn, said at least one electro-functional yarn extends along said longitudinal axis between said first and second ends; and wherein said non-metallic polymeric warp yarns have a greater heat-shrinkage ratio than said at least one electro-functional member causing said non-metallic polymeric warp yarns to be shortened in the lengthwise direction along said longitudinal axis relative to said at least one electro-functional member upon being heated, wherein a portion of some or all of said heat-shrinkable non-metallic warp yarns are in their heat-shrunk state, and a portion of said electro-functional yarn extends beyond said heat-shrinkable non-metallic warp yarns.

2. The textile sleeve of claim 1 wherein said wall has opposite first and second edges extending along said longitudinal axis between said opposite ends, said first and second edges being configured to overlap one another such that said first edge is radially outward from said second edge, and said at least one electro-functional member is interlaced adjacent said second edge.

3. The textile sleeve of claim 2 wherein said at least one electro-functional member underlies and is shielded by a portion of said wall adjacent said first edge.

4. The textile sleeve of claim 1 wherein said at least one electro-functional member includes a plurality of said electro-functional members.

5. The textile sleeve of claim 4 wherein said plurality of electro-functional members underlie and are shielded by a portion of said wall.

6. The textile sleeve of claim 4 wherein said wall has opposite first and second edges overlapping one another and said plurality of electro-functional members are adjacent said second edge underlying a portion of said wall adjacent said first edge.

7. The textile sleeve of claim 6 wherein said wall is heat-set to bias said opposite first and second edges into overlapping relation with one another.

8. The textile sleeve of claim 1 wherein said at least one electro-functional member is one of metallic yarn, fiber optic stands or wires.

9. A method of constructing a textile sleeve, comprising:

forming a wall by interlacing heat-shrinkable non-metallic polymeric warp yarn with weft yarn, the warp yarn extending lengthwise along a longitudinal axis of the sleeve and the weft yarn extending widthwise transversely to the longitudinal axis between opposite first and second edges;

interlacing at least one electro-functional member in yarns of the wall with the at least one electro-functional yarn extending along the longitudinal axis, wherein the non-metallic polymeric warp yarns have a greater heat-shrinkage ratio than the at least one electro-functional member;

cutting the wall and at least one electro-functional member to a first length extending between opposite ends of the wall and the at least one electro-functional member; and heating the wall and causing the non-metallic polymeric warp yarns to shorten lengthwise to a second length that is shorter than the first length and causing the at least one electro-functional member that substantially retains its first length to project longitudinally beyond the shrunken opposite ends of the wall.

10. The method of claim 9 further including shielding the at least one electro-functional member from direct exposure to the environment by overlapping the at least one electro-functional member with a portion of the wall.

11. The method of claim 10 further including wrapping opposite lengthwise extending edges of the wall into overlapping relation with one another.

12. The method of claim 11 further including heat-setting the wall and causing at least some of the weft yarn to take on a heat-set curl to bias the opposite edges into their overlapping relation with one another.

13. The method of claim 9 further including selecting the at least one electro-functional member from the group consisting essentially of metallic yarn, fiber optic strand, and wire.

* * * * *